US009646540B2

(12) United States Patent
Kim

(10) Patent No.: US 9,646,540 B2
(45) Date of Patent: May 9, 2017

(54) ORGANIC LIGHT EMITTING DIODE DISPLAY DEVICE AND METHOD OF DRIVING THE SAME

(71) Applicant: LG Display Co., Ltd., Seoul (KR)

(72) Inventor: Binn Kim, Seoul (KR)

(73) Assignee: LG Display Co., Ltd., Seoul (KR)

( * ) Notice: Subject to any disclaimer, the term of this patent is extended or adjusted under 35 U.S.C. 154(b) by 228 days.

(21) Appl. No.: 14/500,439

(22) Filed: Sep. 29, 2014

(65) Prior Publication Data

US 2015/0109278 A1 Apr. 23, 2015

(30) Foreign Application Priority Data

Oct. 17, 2013 (KR) ..... 10-2013-0123975

(51) Int. Cl.
*G09G 3/32* (2016.01)
*G09G 3/3266* (2016.01)
*G09G 3/3233* (2016.01)

(52) U.S. Cl.
CPC ..... *G09G 3/3266* (2013.01); *G09G 3/3233* (2013.01); *G09G 2300/0819* (2013.01); *G09G 2300/0852* (2013.01); *G09G 2300/0866* (2013.01)

(58) Field of Classification Search
CPC .. G09G 3/30; G09G 3/36; G09G 5/00; G09G 5/10; G09G 3/3266; G09G 3/3233; G09G 2300/0819; G09G 2300/0852; G09G 2300/0866; G06F 3/038
See application file for complete search history.

(56) References Cited

U.S. PATENT DOCUMENTS

2007/0103419 A1* 5/2007 Uchino ..... G09G 3/2011 345/92
2007/0164959 A1 7/2007 Childs
2009/0244049 A1* 10/2009 Yamamoto ..... G09G 3/3233 345/212
2009/0251493 A1* 10/2009 Uchino ..... G09G 3/3233 345/690
2011/0316892 A1 12/2011 Sung et al.
(Continued)

FOREIGN PATENT DOCUMENTS

CN 102298900 A 12/2011
CN 103168324 A 5/2013
(Continued)

*Primary Examiner* — Lun-Yi Lao
*Assistant Examiner* — Johny Lau
(74) *Attorney, Agent, or Firm* — Birch, Stewart, Kolasch & Birch, LLP

(57) ABSTRACT

An organic light emitting diode (OLED) display device including a first transistor configured to supply a data voltage to a first node according to a scan signal; a first capacitor connected to the first node at one end of the first capacitor, and connected to a second node at the other end; a second transistor configured to supply a reference voltage to the second node according to a sensing signal; a driving transistor including a drain electrode receiving a high-level source voltage or an initial voltage, a gate electrode connected to the second node, and a source electrode connected to a third node; and an OLED including a cathode electrode receiving a low-level source voltage and an anode electrode connected to the third node.

18 Claims, 9 Drawing Sheets

(56) References Cited

U.S. PATENT DOCUMENTS

| | | | | |
|---|---|---|---|---|
| 2012/0038605 | A1* | 2/2012 | Han | H05B 33/0896 345/211 |
| 2013/0088417 | A1 | 4/2013 | Kim et al. | |
| 2013/0120228 | A1 | 5/2013 | Yoon | |
| 2013/0181969 | A1 | 7/2013 | Kishi | |

FOREIGN PATENT DOCUMENTS

| | | | |
|---|---|---|---|
| CN | 22313-1450 | A | 6/2013 |
| EP | 2 400 480 | A1 | 12/2011 |
| WO | WO 2010/087420 | A1 | 8/2010 |

* cited by examiner

ORGANIC LIGHT EMITTING DIODE DISPLAY DEVICE AND METHOD OF DRIVING THE SAME

CROSS-REFERENCE TO RELATED APPLICATIONS

This application claims the benefit of the Korean Patent Application No. 10-2013-0123975 filed on Oct. 17, 2013, which is hereby incorporated by reference as if fully set forth herein.

BACKGROUND OF THE INVENTION

Field of the Invention

The present invention relates to a display device, and more particularly to an organic light emitting diode (OLED) display device and a method of driving the same.

Discussion of the Related Art

Research is being done on various flat panel display devices that are thin and light, and have low power consumption. For example, flat panel display devices are categorized into liquid crystal display (LCD) devices, plasma display panel (PDP) devices, OLED display devices, etc.

OLED display devices apply a data voltage (Vdata) having various levels to respective pixels to display different grayscale levels, thereby realizing an image. Thus, each pixel includes one or more capacitors, an OLED, and a driving transistor that functions as a current control element. In more detail, a current flowing in the OLED is controlled by the driving transistor, and the amount of a current flowing in the OLED is changed by the threshold voltage deviation of the driving transistor and various parameters, causing the luminance non-uniformity of a screen.

In addition, a threshold voltage deviation of a driving transistor occurs because a characteristic of the driving transistor is changed by a variable manufacturing process. To solve such a problem, a compensation circuit including a plurality of transistors and a capacitor is provided in each pixel so as to compensate for the threshold voltage deviation.

In particular, a plurality of control circuits for controlling a plurality of transistors such as a switching transistor and an emission control transistor are used, and for example, may include a scan signal, an emission control signal, etc. Because an emission control transistor driven by the emission control signal maintains a turn-on state for a long time, the emission control transistor is quickly deteriorated, causing a degradation in a quality of an image.

Moreover, when a threshold voltage of the driving transistor is negative, because it is unable to compensate for the negative threshold voltage, a level of a current flowing in an OLED is changed due to a deviation of the negative threshold voltage and a deviation of a low-level source voltage caused by an IR drop, causing a degradation in a quality of an image.

SUMMARY OF THE INVENTION

Accordingly, one object of the present invention is to provide an OLED display device and a method of driving the same that substantially obviate one or more problems due to limitations and disadvantages of the related art.

One aspect of the present invention is to provide an OLED display device and a method of driving the same, which can compensate for a threshold voltage deviation of a driving transistor and prevent the degradation of an image due to a deterioration of an emission control transistor.

To achieve these and other advantages and in accordance with the purpose of the invention, as embodied and broadly described herein, the present invention provides in one aspect an organic light emitting diode (OLED) display device including a first transistor configured to supply a data voltage to a first node according to a scan signal; a first capacitor connected to the first node at one end of the first capacitor, and connected to a second node at the other end; a second transistor configured to supply a reference voltage to the second node according to a sensing signal; a driving transistor including a drain electrode receiving a high-level source voltage or an initial voltage, a gate electrode connected to the second node, and a source electrode connected to a third node; and an OLED including a cathode electrode receiving a low-level source voltage and an anode electrode connected to the third node.

In another aspect, the present invention provides a method of driving an organic light emitting diode (OLED) display device including first to fourth transistors, a driving transistor, first and second capacitors, and an OLED. The method includes when the second and third transistors are turned on and an initial voltage is being applied to a drain electrode of the driving transistor, initializing a voltage of a first node and a voltage of a third node to the initial voltage, and initializing a voltage of the second node to a reference voltage, wherein the first node is connected to one end of each of the first and second capacitors, the third node is connected to the other end of the second capacitor and a source electrode of the driving transistor, and the second node is connected to the other end of the first capacitor and a gate electrode of the driving transistor; when the second and third transistors are turned on and a high-level source voltage is being applied to the drain electrode of the driving transistor, maintaining the voltage of the second node as the reference voltage, and storing, by the first capacitor, a threshold voltage of the driving transistor; when the first and fourth transistors are turned on, applying a data voltage to the first node; and when the first to fourth transistors are turned off, emitting light from the OLED, wherein an anode electrode of the OLED is connected to the third node.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the embodiments of the present invention, examples of which are illustrated in the accompanying drawings. Wherever possible, the same reference numbers will be used throughout the drawings to refer to the same or like parts.

Figure 1:
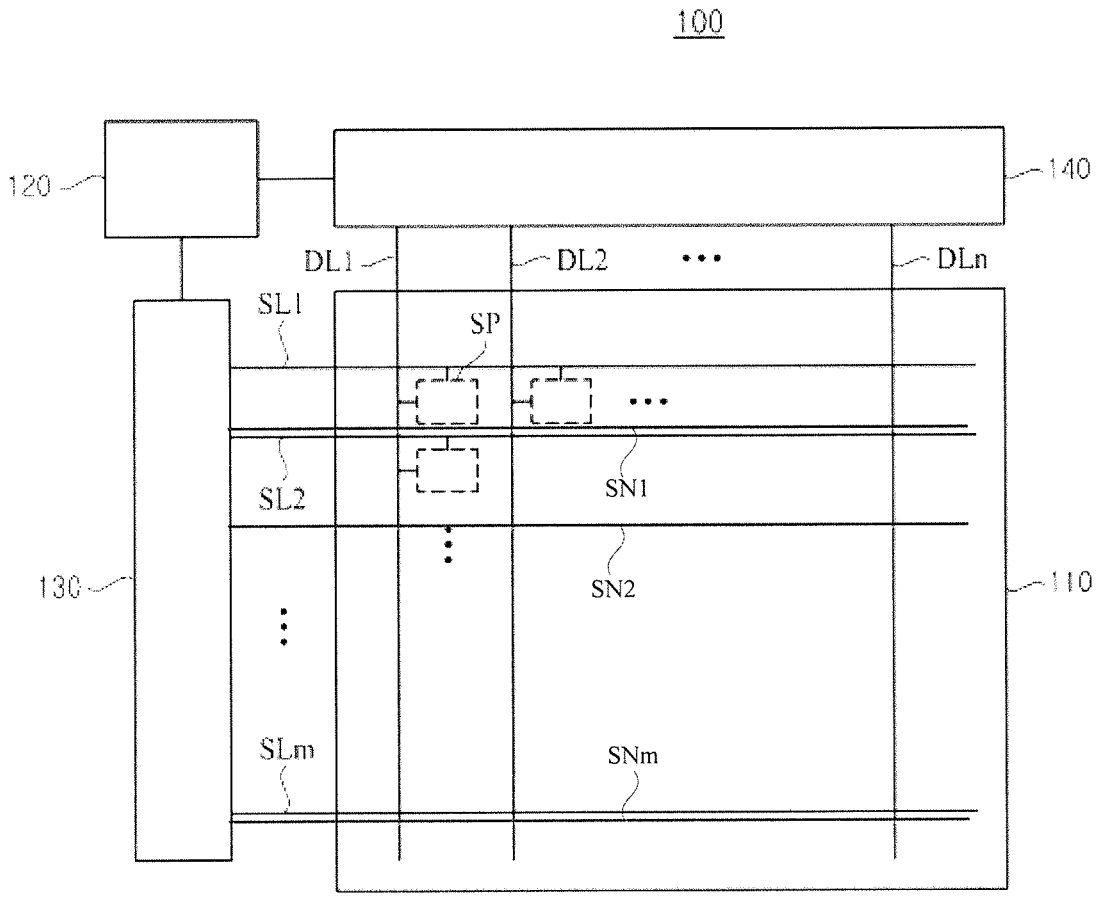
FIG. 1 is a diagram schematically illustrating a configuration of an OLED display device according to embodiments of the present invention.

FIG. 1 is a diagram schematically illustrating a configuration of an OLED display device 100 according to embodiments of the present invention. As illustrated in FIG. 1, the OLED display device 100 includes a panel 110, a timing controller 120, a scan driver 130, and a data driver 140.

The panel 110 includes a plurality of sub-pixels SP arranged in a matrix type. The sub-pixels SP included in the panel 110 emit light according to respective scan signals (which are supplied through a plurality of scan lines SL1 to SLm from the scan driver 130) and respective data signals that are supplied through a plurality of data lines DL1 to DLn from the data driver 140. The sensing signals are supplied to the sub-pixels through a plurality of sensing lines SN1 to SNm. Thus, one sub-pixel includes an OLED, and a plurality of transistors and capacitors for driving the OLED. The detailed configuration of each of the sub-pixels SP will be described in detail with reference to FIG. 2.

The timing controller 120 receives a vertical sync signal Vsync, a horizontal sync signal Hsync, a data enable signal DE, a clock signal CLK, and video signals from the outside. Also, the timing controller 120 aligns external input video signals to digital image data RGB in units of a frame.

For example, the timing controller 120 controls the operational timing of each of the scan driver 130 and the data driver 140 with a timing signal that includes the vertical sync signal Vsync, the horizontal sync signal Hsync, the data enable signal DE, and the clock signal CLK. Thus, the timing controller 120 generates a gate control signal GCS for controlling the operational timing of the scan driver 130 and a data control signal DCS for controlling the operational timing of the data driver 140.

The scan driver 130 generates a scan signal "Scan" that enables the operations of transistors included in each of the sub-pixels SP included in the panel 110, according to the gate control signal GCS supplied from the timing controller 120, and supplies the scan signal "Scan" to the panel 110 through the scan lines SL.

Further, the data driver 140 generates data signals with the digital image data RGB and the data control signal DCS supplied from the timing controller 120, and supplies the generated data signals to the panel 110 through the respective data lines DL.

Figure 2:
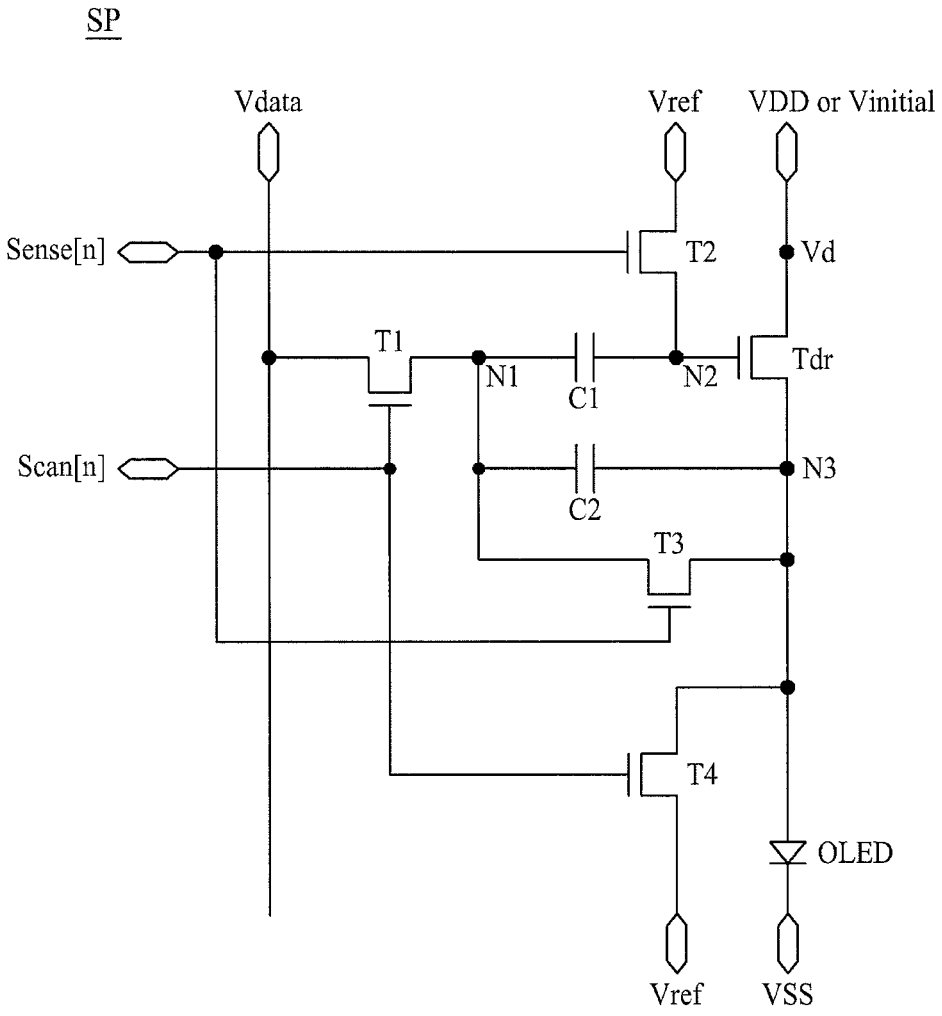
FIG. 2 is a diagram schematically illustrating an equivalent circuit of a sub-pixel of FIG. 1.

Hereinafter, the detailed configuration of each sub-pixel will be described in detail with reference to FIGS. 1 and 2. In particular, FIG. 2 is a diagram schematically illustrating an equivalent circuit of a sub-pixel of FIG. 1. As illustrated in FIG. 2, each sub-pixel SP includes first to fourth transistors T1 to T4, a driving transistor Tdr, first and second capacitors C1 and C2, and an OLED.

The first to fourth transistors T1 to T4 and the driving transistor Tdr, as illustrated in FIG. 2, are NMOS transistors, but are not limited thereto. As another example, a PMOS transistor may be applied thereto, in which case a voltage for turning on the NMOS transistor has a polarity opposite to that of a voltage for turning on the PMOS transistor.

A data voltage Vdata is supplied to a drain electrode of the first transistor T1 as a data signal, and a scan signal Scan is applied to a gate electrode of the first transistor T1. Also, a source electrode of the first transistor T1 is connected to a first node N1 which is connected to one end of the first capacitor C1 and one end of the second capacitor C2.

Therefore, an operation of the first transistor T1 can be controlled according to the scan signal Scan supplied through a scan line SL. For example, the first transistor T1 can be turned on according to the scan signal Scan, and can supply the data voltage Vdata to the first node N1.

Subsequently, a reference voltage Vref is supplied to a source electrode of the second transistor T2, and a sensing signal Sense is applied to a gate electrode of the second transistor T2. Also, a drain electrode of the second transistor T2 is connected to a second node N2 which is connected to the other end of the first capacitor C1 and a gate electrode of the driving transistor Tdr.

Therefore, an operation of the second transistor T2 can be controlled according to the sensing signal Sense supplied through a sensing line. For example, the second transistor T2 can be turned on according to the sensing signal Sense, and can supply the reference voltage Vref to the second node N2, thereby initializing a voltage of the second node N2 to the reference voltage. Also, the sensing signal Sense is changed from a low-level voltage to a high-level voltage in units of at least two frames, and thus, the second transistor T2 can be turned on in units of at least two frames.

A drain electrode of the third transistor T3 is connected to the first node N1, and a source electrode of the third transistor T3 is connected to a third node N3 which is connected to the other end of the second capacitor C2 and a source electrode of the driving transistor Tdr. Also, the sensing signal Sense is applied to a gate electrode of the third transistor T3.

Therefore, an operation of the third transistor T3 can be controlled according to the sensing signal Sense supplied through the sensing line. For example, the third transistor T3 can be turned on according to the sensing signal Sense, and can connect the first node N1 to the third node N3, thereby making a voltage of the first node N1 equal to a voltage of the third node N3.

Subsequently, the reference voltage Vref is supplied to a source electrode of the fourth transistor T4, and the scan signal Scan is applied to a gate electrode of the fourth transistor T4. Also, a drain electrode of the fourth transistor T4 is connected to the third node N3. In FIG. 2, the reference voltage Vref is supplied to the source electrode of the fourth transistor T4, but the present invention is not limited thereto. In another embodiment, a low-level source voltage VSS may be supplied to the source electrode of the fourth transistor T4.

Therefore, an operation of the fourth transistor T4 can be controlled according to the scan signal Scan supplied through the scan line SL. For example, the fourth transistor T4 can be turned on according to the scan signal Scan, and supply the reference voltage to the third node N3.

When the driving transistor Tdr and the fourth transistor T4 are simultaneously turned on, a higher voltage "Vref+a"

than the reference voltage Vref can be supplied to the third node N3. This is because a current path is formed between a high-level source voltage VDD terminal connected to a drain electrode of the driving transistor Tdr and a reference voltage Vref terminal by simultaneously turning on the driving transistor Tdr and the fourth transistor T4, and thus, a voltage is dropped by the fourth transistor T4. Here, a voltage "a" is a voltage with the consideration of the drop of the voltage caused by the current path, and may be changed according to a gate voltage of the driving transistor Tdr.

The first capacitor C1 is connected between the first and second nodes N1 and N2, and stores a threshold voltage (Vth) of the driving transistor Tdr. Thus, the first capacitor C1 may be a sensing capacitor used to sense the threshold voltage of the driving transistor Tdr. The second capacitor C2 is connected between the first and third nodes N1 and N3, and may be a storage capacitor that holds a data voltage during one frame to maintain a constant amount of current flowing in the OLED, and thus maintains a constant gray scale displayed by the OLED.

A high-level source voltage VDD or an initial voltage Vinitial is supplied to the drain electrode of the driving transistor Tdr, the gate electrode of the driving transistor Tdr is connected to the second node N2, and the source electrode of the driving transistor Tdr is connected to the third node N3 which is connected to an anode electrode of the OLED and the drain electrode of the fourth transistor T4.

For example, the initial voltage Vinitial may be supplied to the drain electrode of the driving transistor Tdr in units of at least two frames. In other words, the high-level source voltage VDD may be supplied to the drain electrode of the driving transistor Tdr without any change, and then, the initial voltage Vinitial may be supplied to the drain electrode of the driving transistor Tdr in units of at least two frames.

Moreover, the initial voltage Vinitial may be a voltage lower than the reference voltage Vref. This is for when the initial voltage Vinitial is supplied to the drain electrode of the driving transistor Tdr and the reference voltage Vref is supplied to the gate electrode of the driving transistor Tdr, the driving transistor Tdr is turned on, and initializes the voltage of the third node N3 to the initial voltage Vinitial. The initial voltage Vinitial may be a voltage lower than a voltage which is higher than the low-level source voltage VSS by a threshold voltage of the OLED.

Therefore, the voltage of the third node N3 is initialized to the initial voltage Vinitial, and thus, a current does not flow in the OLED, whereby the OLED does not emit light.

The driving transistor Tdr can adjust an amount of current, flowing in the OLED, according to a voltage supplied to the second node N2 connected to the gate electrode of the driving transistor Tdr. For example, the OLED emits light, and when a voltage higher than the data voltage Vdata by the threshold voltage (Vth) of the driving transistor Tdr is supplied to the second node N2, an amount of current flowing in the OLED may be proportional to a level of the data voltage Vdata.

Therefore, the OLED display device according to embodiments of the present invention can respectively supply various levels of data voltages to the sub-pixels SP to display different gray scales, thereby displaying an image.

The OLED display device according to embodiments of the present invention uses a source follower method in which a fixed voltage is not supplied to the source electrode of the driving transistor Tdr, and a load is connected to the source electrode. Therefore, the OLED display device according to embodiments of the present invention can sense the threshold voltage of the driving transistor Tdr even when the threshold voltage of the driving transistor Tdr is negative, and thus can compensate for a deviation of the threshold voltage irrespective of a polarity of the threshold voltage.

In more detail, when a threshold voltage of a driving transistor included in each sub-pixel of an OLED display device is sensed by a diode connection method in which a gate electrode and a drain electrode of the driving transistor are connected to each other, and when the threshold voltage of the driving transistor is negative, the threshold voltage cannot be sensed. However, in embodiments of the present invention, by using the source follower method, the threshold voltage of the driving transistor is sensed even when the threshold voltage of the driving transistor is negative.

In other words, the OLED display device according to embodiments of the present invention compensates for a change, caused by a deviation of a positive or negative threshold voltage, in a current flowing in the OLED, and maintains a constant current based on the data voltage Vdata irrespective of a polarity of the threshold voltage as well as the deviation of the threshold voltage. Further, the anode electrode of the OLED is connected to the third node N3, and the low-level source voltage VSS is supplied to a cathode electrode of the OLED.

Hereinafter, an operation of each sub-pixel included in the OLED display device according to embodiments of the present invention will be described in detail with reference to FIGS. 3 and 5A to 5D. The OLED display device according to embodiments of the present invention does not sense the threshold voltage of the driving transistor in units of one frame but senses the threshold voltage of the driving transistor in units of at least two frames.

In FIGS. 3 and 5A to 5D, in addition to a period in which the threshold voltage of the driving transistor is sensed, an initial period, a sensing period, a sampling period, and an emission period will be separately described, and a sub-pixel SP connected to an nth scan line of a plurality of scan lines will be described as an example.

Figure 3:
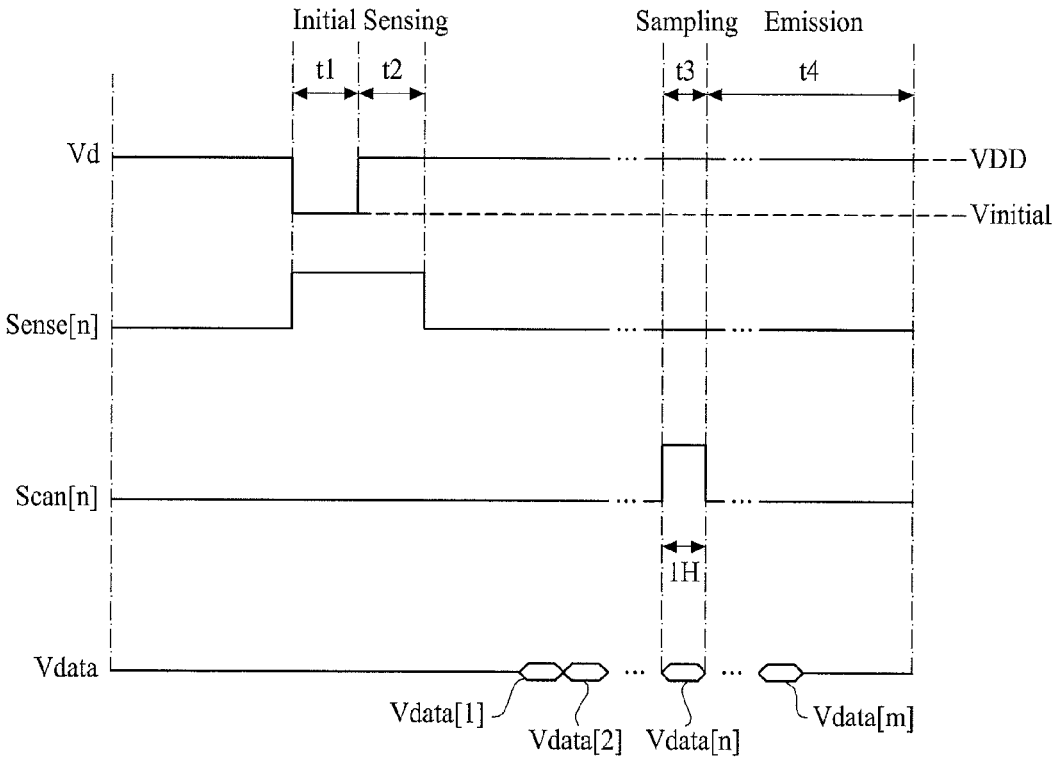
FIG. 3 is a timing chart of control signals supplied to the equivalent circuit of FIG. 2.

In more detail, FIG. 3 is a timing chart of control signals supplied to the equivalent circuit of FIG. 2, and FIGS. 5A to 5D are diagrams illustrating describing a method of driving an OLED display device according to embodiments of the present invention. During an initial period t1, as shown in FIG. 3, a high-level sensing signal Sense and a low-level scan signal Scan are applied, and the initial voltage Vinitial is supplied to the drain electrode of the driving transistor.

Figure 5A:
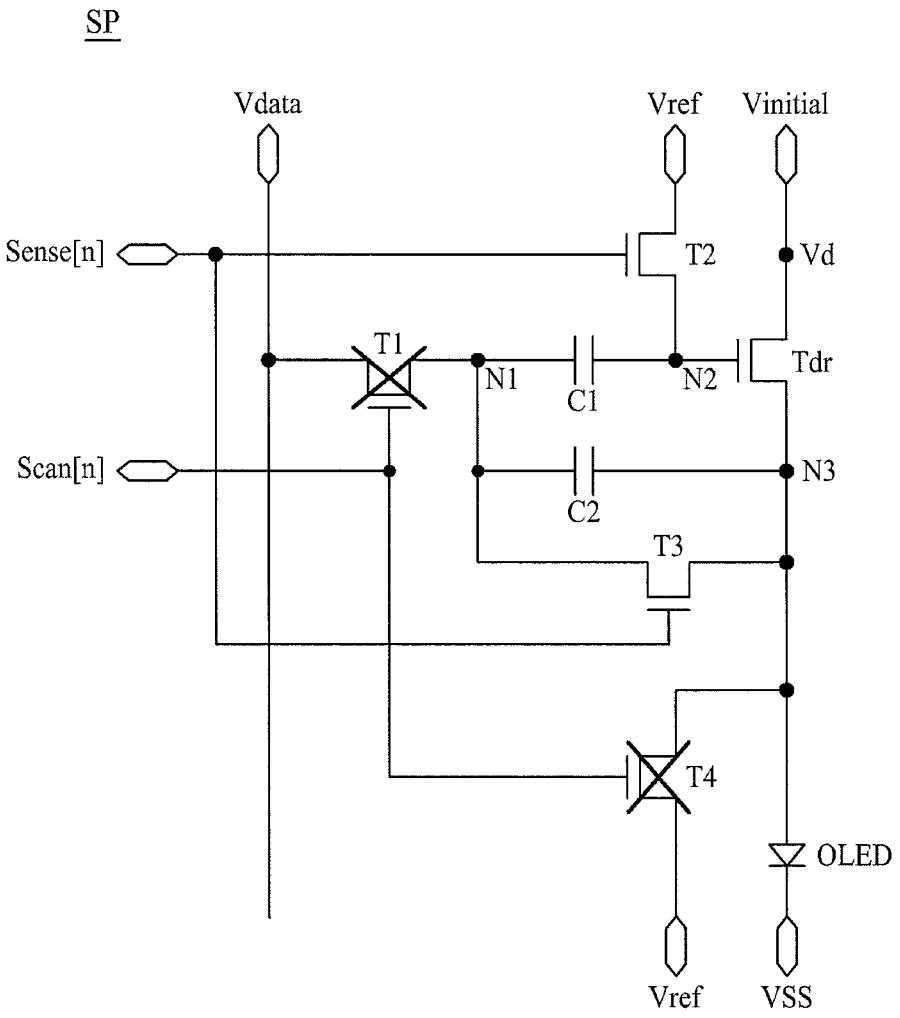
FIGS. 5A to 5D are diagrams illustrating a method of driving an OLED display device according to embodiments of the present invention.

Therefore, as illustrated in FIG. 5A, the second and third transistors T2 and T3 are turned on by a high-level sensing signal Sense[n], the first and fourth transistors T1 and T4 are turned off by a low-level scan signal Scan[n], and the driving transistor Tdr is turned on with the reference voltage Vref higher than the initial voltage Vinitial.

As a result, during the initial period t1, the voltage of the second node N2 is initialized to the reference voltage Vref, and the voltages of the first and third nodes N1 and N3 are initialized to the initial voltage Vinitial. For example, during the initial period t1, the second transistor T2 is turned on, and thus, a current path is formed between the second node N2 and the reference voltage Vref terminal, thereby initializing the voltage of the second node N2 to the reference voltage Vref.

Also, the voltage of the second node N2 connected to the gate electrode of the driving transistor may be initialized to the reference voltage Vref higher than the initial voltage Vinitial, and thus, the driving transistor Tdr is turned on, thereby initializing the voltage of the third node N3 to the initial voltage Vinitial. Furthermore, the third transistor T3 is turned on, and thus, a current path is formed between the first and third nodes N1 and N3, thereby initializing the voltage of the first node N1 to the initial voltage Vinitial that is the voltage of the third node N3.

Here, the initial voltage Vinitial may be set to a voltage "Vinitial<Vth_oled+VSS" which is lower than a sum of a threshold voltage (Vth_oled) of the OLED and a voltage VSS at the cathode electrode of the OLED. Also, the threshold voltage (Vth_oled) of the OLED is a voltage with which the OLED starts to emit light, and when a voltage which is a difference voltage between both ends of the OLED and is lower than the threshold voltage (Vth_oled) is applied, the OLED does not emit light.

Therefore, during the initial period t1, the OLED is turned off by initializing the voltage of the third node N3 to the initial voltage Vinitial. Subsequently, during a sensing period t2 in which the threshold voltage (Vth) of the driving transistor Tdr is sensed, the high-level sensing signal Sense and the low-level scan signal Scan are applied, and a high-level source voltage VDD is supplied to the drain electrode of the driving transistor.

Figure 5B:
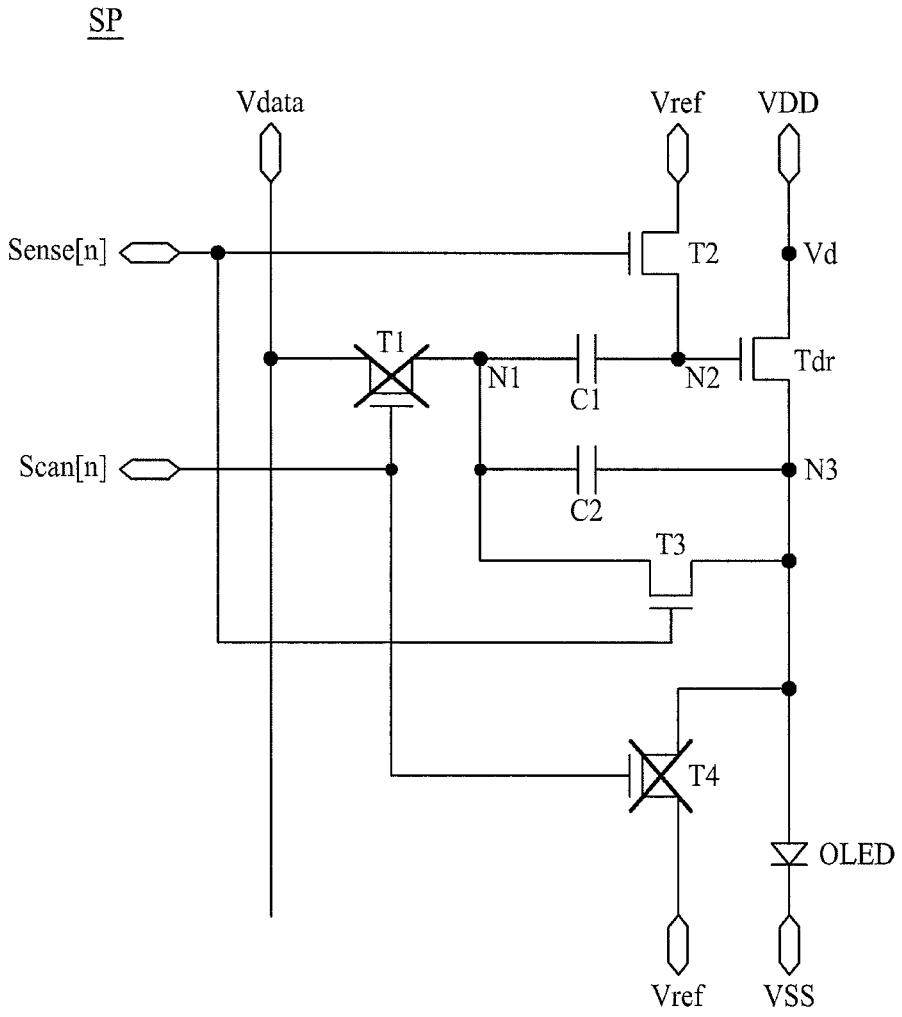

Therefore, as illustrated in FIG. 5B, the second and third transistors T2 and T3 are turned on by the high-level sensing signal Sense[n], and the first and fourth transistors T1 and T4 are turned off by the low-level scan signal Scan[n]. As a result, during the threshold voltage (Vth) sensing period t2, the voltage of the second node N2 maintains the reference voltage Vref, and the voltages of the first and third nodes N1 and N3 increase from the initial voltage Vinitial to a voltage "Vref−Vth" equal to a difference between the reference voltage Vref and the threshold voltage (Vth) of the driving transistor Tdr during the initial period t1.

For example, during the threshold voltage (Vth) sensing period t2, the second transistor T2 maintains a turn-on state, and thus, the voltage of the second node N2 continuously maintains the reference voltage Vref. Also, in order for a voltage difference between the second and third nodes N2 and N3 to maintain the threshold voltage (Vth) of the driving transistor Tdr, the voltage of the third node N3 may increase to a voltage "Vref−Vth." The third transistor T3 maintains a turn-on state, and thus, the voltage of the first node N1 increases to the voltage "Vref−Vth". As a result, the first capacitor C1 stores the threshold voltage (Vth) of the driving transistor Tdr.

Here, the voltage "Vref−Vth" that is a voltage of each of the first and third nodes N1 and N3 can be set to a voltage "Vref−Vth<Vth_oled+VSS" which is lower than the sum of the threshold voltage (Vth_oled) of the OLED and the voltage VSS at the cathode electrode of the OLED. Accordingly, during the threshold voltage (Vth) sensing period t2, the voltage of the third node N3 can be maintained as lower than the voltage "Vref−Vth", and thus, the OLED maintains a turn-off state.

As described above, the OLED display device according to embodiments of the present invention can sense the threshold voltage (Vth) of the driving transistor Tdr in units of at least two frames, and thus, the above-described initial period t1 and threshold voltage sensing period t2 may be repeated in units of at least two frames.

Moreover, the initial period t1 and the threshold voltage sensing period t2 may be included in a vertical blank time (V.B.T.). The initial period t1 and the threshold voltage sensing period t2 can be adjusted by adjusting a supply time of the initial voltage Vinitial supplied to the drain electrode of the driving transistor and a pulse width of the high-level sensing signal in the vertical blank time. Therefore, a threshold voltage deviation can be more accurately compensated for by adjusting the initial period t1 and the threshold voltage sensing period t2 in the vertical blank time.

Figure 5C:
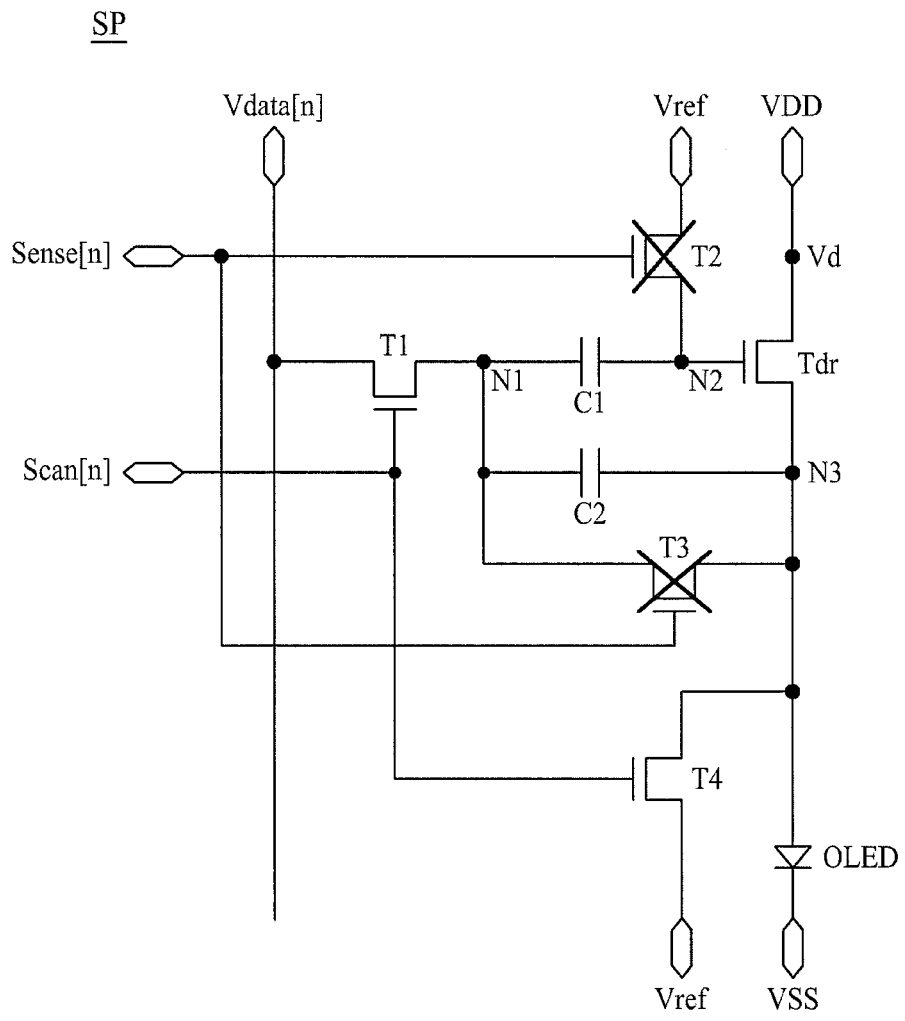

Subsequently, during a sampling period t3, the high-level scan signal Scan[n] and the low-level sensing signal Sense [n] are applied, and the high-level source voltage VDD is supplied to the drain electrode of the driving transistor. Therefore, as illustrated in FIG. 5C, the first and fourth transistors T1 and T4 are turned on by the high-level scan signal Scan[n], and the second and third transistors T2 and T3 are turned off by the low-level sensing signal Sense[n].

As a result, during the sampling period t3, a data voltage Vdata[n] is supplied to the first node N1, and a voltage "Vdata[n]+Vth" equal to a sum of the data voltage Vdata[n] (which is the voltage of the first node N1) and the threshold voltage (Vth) of the driving transistor Tdr is supplied to the second node N2. Also, a voltage "Vref+a" higher than the reference voltage Vref is supplied to the third node N3.

For example, during the sampling period t3, the first transistor T1 is turned on, and thus, a current path is formed between a data line and the first node N1, whereby the data voltage Vdata[n] is supplied to the first node N1. Here, the data voltage Vdata[n] may correspond to an nth data voltage supplied to a sub-pixel SP connected to an nth scan line.

Moreover, due to the first capacitor C1 storing the threshold voltage (Vth) of the driving transistor Tdr, the voltage of the second node N2 is a voltage "Vdata[n]+Vth" higher than the data voltage Vdata[n] by the threshold voltage (Vth) of the driving transistor Tdr. As a result, during the sampling period t3, the nth data voltage Vdata[n] may be stored in the first capacitor C1, and thus, a data voltage of the driving transistor Tdr can be sampled. In other words, during the sampling period t3, the first capacitor C1 samples a data voltage which is necessary for the OLED to emit light during the emission period t4.

As described above, the OLED display device according to embodiments of the present invention senses the threshold voltage (Vth) of the driving transistor in units of at least two frames. Each OLED can start to emit light immediately after sampling of a data voltage corresponding to a corresponding scan line is completed in each frame.

In other words, the initial period and the sensing period are repeated in units of at least two frames so as to sense the threshold voltage of the driving transistor for each scan line, the threshold voltages of the driving transistors included in respective sub-pixels connected to all the scan lines are simultaneously sensed, and each OLED starts to emit light immediately after sampling of a data voltage is completed in each frame. This will be described in more detail with reference to FIG. 4.

Figure 4:
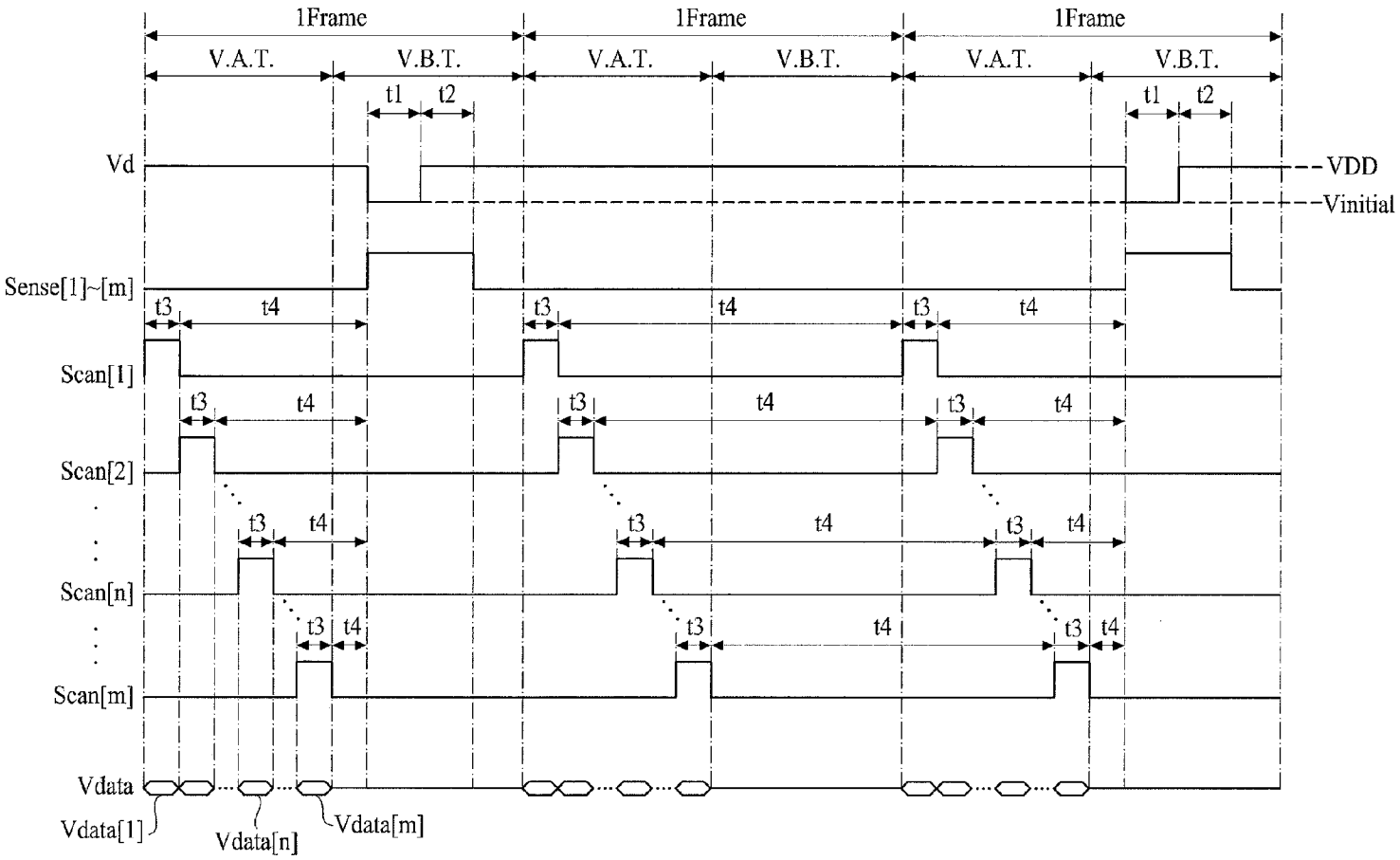
FIG. 4 is a detailed diagram of the timing chart shown in FIG. 3.

In particular, FIG. 4 is a detailed diagram of the timing chart shown in FIG. 3. In the OLED display device according to embodiments of the present invention, when it is assumed that the number of scan lines is m number, scan signals Scan[1], Scan[2], Scan[n] and Scan[m] are respectively applied to a first scan line, a second scan line, an nth scan line, and an mth scan line, and first to mth data voltages Vdata[1] to Vdata[m] are applied to one data line intersecting each of the scan lines.

Here, a driving period may include an initial period t1, a sensing period t2, a sampling period t3, and an emission period t4 for each scan line of the OLED. As shown, the initial period t1 and the sensing period t2 are repeated for each scan line in units of two frames. In FIG. 4, for convenience of description, sensing the threshold voltage of the driving transistor in units of two frames is described as an example, but the present invention is not limited thereto.

As another example, the threshold voltage of the driving transistor may be sensed in units of three or more frames.

Moreover, each frame is divided into a vertical active time (V.A.T.) and the vertical blank time (V.B.T.). Here, the vertical active time denotes a time in which an effective data voltage is applied for each scan line, and the vertical blank time denotes a time which is between adjacent vertical active times and in which the effective data voltage is not applied.

As shown in FIG. 4, the OLED display device according to embodiments of the present invention includes the initial period t1 and the sensing period t2 in the vertical blank time (V.B.T.), for sensing the threshold voltage of the driving transistor. In addition, the OLED starts to emit light immediately after the sampling period t3 for a corresponding data voltage is completed for each scan line.

Referring again to FIGS. 3 and 5A to 5D, the fourth transistor T4 is turned on, and thus, the voltage "Vref+a" higher than the reference voltage Vref is supplied to the third node N3. Here, the voltage "a" is a voltage with the consideration of a drop of a voltage caused by a current path formed between the high-level source voltage VDD terminal and the reference voltage Vref terminal by simultaneously turning on the driving transistor Tdr and the fourth transistor T4. Therefore, the voltage of the third node N3 is the voltage "Vref+a" which is obtained by summating the reference voltage Vref and the voltage "a" with the consideration of the drop of the voltage.

During the sampling period t3, because the voltage "Vref+a" of the third node N3 is lower than the sum of the threshold voltage (Vth_oled) of the OLED and the voltage VSS at the cathode electrode of the OLED, the OLED can maintain a turn-off state. Subsequently, during the emission period t4, the sensing signal Sense[n] and the scan signal Scan[n] are all applied at a low level, and the high-level source voltage VDD is supplied to the drain electrode of the driving transistor.

Figure 5D:
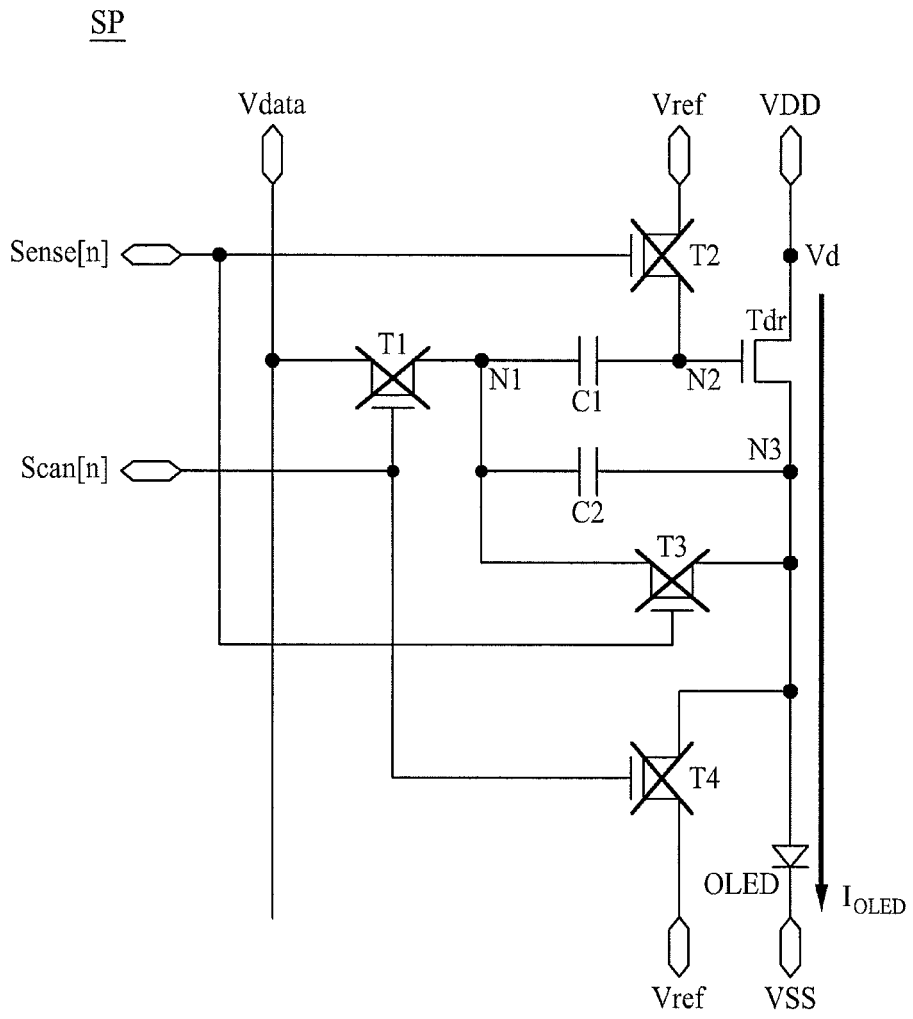

Therefore, as illustrated in FIG. 5D, the first to fourth transistors T1 to T4 are all turned off. As a result, at a time when the emission period t4 starts, the voltage of the first node N1 maintains the data voltage Vdata[n], the voltage of the second node N2 maintains the voltage "Vdata[n]+Vth", and the voltage of the third node N3 maintains the voltage "Vref+a". Subsequently, because the first to fourth transistors T1 to T4 are all turned off, the voltages of the nodes are changed, and thus, when the voltage of the third node N3 is higher than the voltage "VSS+Vth_oled", the OLED starts to emit light.

Although the voltages of the nodes are changed, a voltage difference (Vgs) between the gate electrode and the source electrode of the driving transistor Tdr is not changed. Therefore, a current $I_{OLED}$ flowing in the OLED may be defined as expressed in the following Equation (1). Also, the data voltage Vdata[n] is assumed as a sum "Va+Vref" of the reference voltage Vref and an arbitrary voltage "Va", for simply expressing an equation. In other words, the arbitrary voltage "Va" is proportional to the data voltage Vdata[n] because the reference voltage Vref is constant.

$$\begin{aligned} loled &= K \times (Vgs - Vth)^2 \quad (1) \\ &= K \times (Vdata[n] + Vth - Vref - a - Vth)^2 \\ &= K \times (Va + Vref - Vref - a)^2 \\ &= K \times (Va - a)^2 \end{aligned}$$

where K is a proportional constant and is a value determined based on a structure and physical characteristic of the driving transistor Tdr. K can be determined based on a mobility of the driving transistor Tdr and a ratio "W/L" of a channel width "W" and a channel length "L" of the driving transistor Tdr. The threshold voltage (Vth) of the driving transistor Tdr does not always have a constant value, and a deviation of threshold voltage (Vth) of the driving transistor Tdr occurs depending on an operating state of the driving transistor Tdr.

In other words, referring to Equation (1), in the OLED display device according to embodiments of the present invention, the current $I_{OLED}$ flowing in the OLED is not affected by the threshold voltage (Vth) of the driving transistor Tdr and the low-level source voltage VSS during the emission period t4, and may be determined based on the arbitrary voltage "Va" proportional to a data voltage.

Accordingly, the OLED display device according to the embodiments of the present invention compensates for a deviation of the threshold voltage caused by an operating state of the driving transistor and a deviation of the low-level source voltage caused by IR drop, and thus maintains the current flowing in the OLED without any change, thereby preventing a quality of an image from being degraded.

The above description describes that the current $I_{OLED}$ flowing in the OLED is not affected by the threshold voltage (Vth) of the driving transistor Tdr and the low-level source voltage VSS, and a detailed description will now be made with reference to FIGS. 6 and 7.

Figure 6:
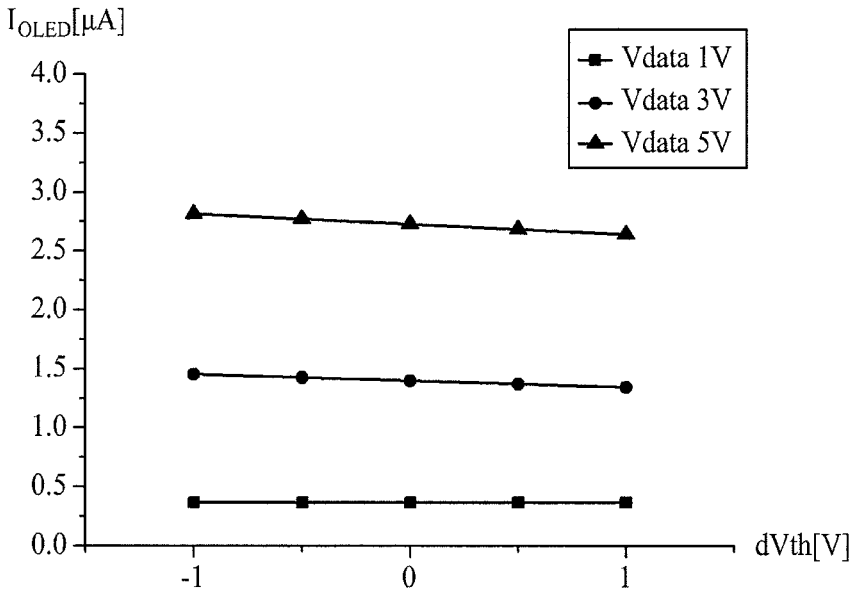
FIGS. 6 and 7 are diagrams of simulation results illustrating a change in a current caused by a low-level source voltage deviation and a threshold voltage deviation of an OLED display device according to embodiments of the present invention.
Figure 7:
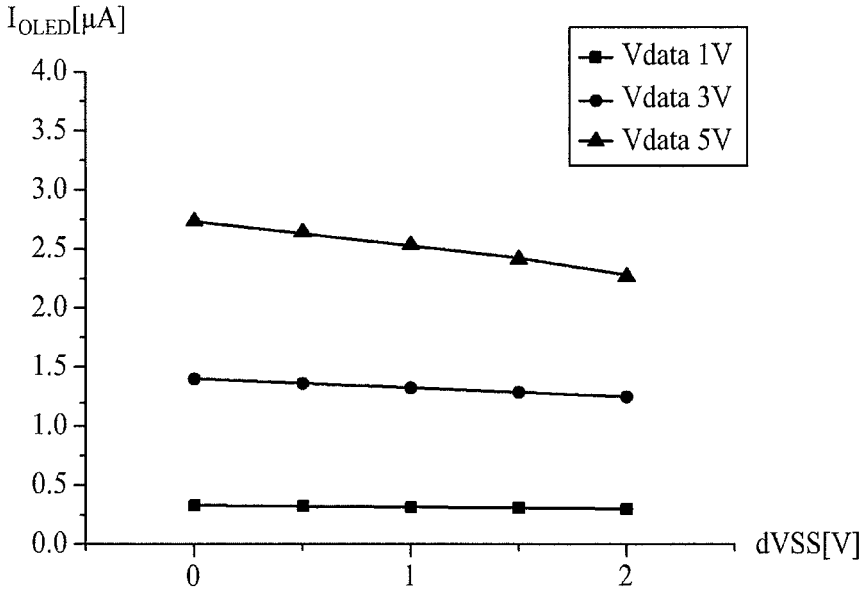

FIGS. 6 and 7 are diagrams of simulation results illustrating a change in a current caused by a low-level source voltage deviation and a threshold voltage deviation of an OLED display device according to embodiments of the present invention.

As shown in FIG. 6, a level of the current $I_{OLED}$ flowing in the OLED is proportional to the data voltage Vdata, but is not greatly changed by a deviation dVth of the threshold voltage (Vth) when the data voltage Vdata is the same.

Moreover, as shown in FIG. 7, the level of the current $I_{OLED}$ flowing in the OLED is proportional to the data voltage Vdata as in FIG. 6, but is not greatly changed by a deviation dVSS of the low-level source voltage VSS when the data voltage Vdata is the same.

As described above, by using a source follower structure, the OLED display device according to embodiments of the present invention compensates for the deviation of the threshold voltage irrespective of a polarity of the threshold voltage of the driving transistor Tdr, and thus maintains a current flowing in an organic light emitting diode without any change, thereby preventing a quality of an image from being degraded.

Moreover, the OLED display device according to the embodiments of the present invention compensates for the deviation of the low-level source voltage caused by an IR drop due to a low-level voltage, and thus maintains the current flowing in the organic light emitting diode without any change, thereby preventing a quality of an image from being degraded. Further, an emission control transistor is not needed, and thus, a quality of an image can be prevented from being degraded due to a deterioration of the emission control transistor.

According to the embodiments of the present invention, even when a threshold voltage of a driving transistor is negative, since the threshold voltage is sensed, a deviation of the threshold voltage is compensated for irrespective of a polarity of the threshold voltage, and a deviation of a low-level source voltage caused by IR drop is compensated for. Accordingly, a current flowing in an OLED is maintained without any significant change, thereby preventing a quality of an image from being degraded.

In addition, according to the embodiments of the present invention, an emission control transistor is not needed, and thus, a quality of an image can be prevented from being degraded due to a deterioration of the emission control transistor.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. An organic light emitting diode (OLED) display device comprising:

a first transistor configured to supply a data voltage to a first node according to a scan signal;

a first capacitor connected to the first node at one end of the first capacitor, and connected to a second node at the other end;

a second transistor configured to supply a reference voltage to the second node according to a sensing signal;

a driving transistor including a drain electrode receiving a high-level source voltage or an initial voltage, a gate electrode connected to the second node, and a source electrode connected to a third node;

a third transistor configured to supply the reference voltage to the third node according to the scan signal; and an OLED including a cathode electrode receiving a low-level source voltage and an anode electrode directly connected to the third node, wherein the initial voltage is supplied to the drain electrode of the driving transistor in units of two or more frames.

2. The OLED display device of claim 1, wherein a period in which the sensing signal is applied is included in a vertical blank time.

3. An organic light emitting diode (OLED) display device comprising:

a first transistor configured to supply a data voltage to a first node according to a scan signal;

a first capacitor connected to the first node at one end of the first capacitor, and connected to a second node at the other end;

a second transistor configured to supply a reference voltage to the second node according to a sensing signal;

a driving transistor including a drain electrode receiving a high-level source voltage or an initial voltage, a gate electrode connected to the second node, and a source electrode connected to a third node;

an OLED including a cathode electrode receiving a low-level source voltage and an anode electrode connected to the third node;

a second capacitor connected between the first and third nodes;

a third transistor configured to connect the first node to the third node according to the sensing signal; and a fourth transistor configured to supply the reference voltage to the third node according to the scan signal.

4. The OLED display device of claim 3, wherein when the second and third transistors are turned on according to the sensing signal and the initial voltage is supplied to the drain electrode of the driving transistor, a voltage of the second node is initialized to the reference voltage, and voltages of the first and third nodes are initialized to the initial voltage.

5. The OLED display device of claim 3, wherein when the second and third transistors are turned on according to the sensing signal and the high-level source voltage is supplied to the drain electrode of the driving transistor, a voltage of the second node maintains the reference voltage, and voltages of the first and third nodes are voltages lower than the reference voltage by a threshold voltage of the driving transistor.

6. The OLED display device of claim 3, wherein when the first and fourth transistors are turned on according to the scan signal and the high-level source voltage is supplied to the drain electrode of the driving transistor, the data voltage is supplied to the first node, and a voltage of the second node is a voltage higher than the data voltage by a threshold voltage of the driving transistor.

7. The OLED display device of claim 3, wherein during an initial period t1, the sensing signal is a high-level sensing signal that turns on the second and third transistors so the initial voltage is supplied to the drain electrode of the driving transistor, a low level-scan signal is applied to turn off the first and fourth transistors, and the driving transistor is turned on with the reference voltage higher than the initial voltage.

8. The OLED display device of claim 7, wherein during the initial period t1, a voltage of the second node is initialized to the reference voltage when the second transistor is turned on, and voltages of the first and third nodes are initialized to the initial voltage when the driving transistor is turned on and the third transistor is turned on with a current path formed between the first and third nodes.

9. The OLED display device of claim 8, wherein the initial voltage is set to a voltage which is lower than a sum of a threshold voltage of the OLED and the low-level source voltage at the cathode electrode of the OLED, wherein the threshold voltage of the OLED is a voltage at which the OLED starts to emit light, and wherein the OLED does not emit light during the initial period t1.

10. The OLED display device of claim 9, wherein during a sensing period t2 in which the threshold voltage of the driving transistor is sensed subsequent to the initial period t1, the high-level sensing signal and the low-level sensing signal are applied, and the high level source voltage is supplied to the drain electrode of the driving transistor.

11. The OLED display device of claim 10, wherein during the sensing period t2, the second and third transistors are turned on via the high-level sensing signal and the first and fourth transistors are turned off via the low-level scan signal, and wherein the voltage of the second node maintains the reference voltage, and the voltages of the first and third nodes increase from the initial voltage to a voltage equal to a difference between the reference voltage and the threshold voltage of the driving transistor during the initial period t1.

12. The OLED display device of claim 10, wherein the initial period t1 and the sensing period t2 are included in a vertical blank time.

13. The OLED display device of claim 10, wherein during a sampling period t3 subsequent to the sensing period t2, the sensing signal is a low-level sensing signal that turns off the second and third transistors and a high level-scan signal is applied to turn on the first and fourth transistors.

14. The OLED display device of claim 13, wherein during the sampling period t3, a data voltage is supplied to the first node, and a voltage equal to a sum of the data voltage and the threshold voltage of the driving transistor is supplied to the second node, and a higher reference voltage higher than the reference voltage is supplied to the third node so a data voltage of the driving transistor is sampled.

15. A method of driving an organic light emitting diode (OLED) display device including first to fourth transistors, a driving transistor, first and second capacitors, and an OLED, the method comprising:

when the second and third transistors are turned on and an initial voltage is being applied to a drain electrode of the driving transistor, initializing a voltage of a first node and a voltage of a third node to the initial voltage, and initializing a voltage of the second node to a reference voltage, wherein the first node is connected to one end of each of the first and second capacitors, the third node is connected to the other end of the second capacitor and a source electrode of the driving transistor, and the second node is connected to the other end of the first capacitor and a gate electrode of the driving transistor;

when the second and third transistors are turned on and a high-level source voltage is being applied to the drain electrode of the driving transistor, maintaining the voltage of the second node as the reference voltage, and storing, by the first capacitor, a threshold voltage of the driving transistor;

when the first and fourth transistors are turned on, applying a data voltage to the first node; and when the first to fourth transistors are turned off, emitting light from the OLED, wherein an anode electrode of the OLED is connected to the third node, wherein the initializing and the storing are executed in units of two or more frames.

16. A method of driving an organic light emitting diode (OLED) display device including first to fourth transistors, a driving transistor, first and second capacitors, and an OLED, the method comprising:

when the second and third transistors are turned on and an initial voltage is being applied to a drain electrode of the driving transistor, initializing a voltage of a first node and a voltage of a third node to the initial voltage, and initializing a voltage of the second node to a reference voltage, wherein the first node is connected to one end of each of the first and second capacitors, the third node is connected to the other end of the second capacitor and a source electrode of the driving transistor, and the second node is connected to the other end of the first capacitor and a gate electrode of the driving transistor;

when the second and third transistors are turned on and a high-level source voltage is being applied to the drain electrode of the driving transistor, maintaining the voltage of the second node as the reference voltage, and storing, by the first capacitor, a threshold voltage of the driving transistor;

when the first and fourth transistors are turned on, applying a data voltage to the first node; and when the first to fourth transistors are turned off, emitting light from the OLED, wherein an anode electrode of the OLED is connected to the third node, wherein the initializing and the storing are executed in a vertical blank time.

17. The method of claim 16, wherein the first and fourth transistors are turned on by a scan signal, and the second and third transistors are turned on by a sensing signal.

18. The method of claim 17, wherein the first transistor supplies the data voltage to the first node according to the scan signal, the second transistor supplies the reference voltage to the second node according to the sensing signal, the third transistor connects the first node to the third node according to the sensing signal, and the fourth transistor supplies the reference voltage to the third node according to the scan signal.

* * * * *